US008591058B2

(12) United States Patent
Concepcion

(10) Patent No.: US 8,591,058 B2
(45) Date of Patent: Nov. 26, 2013

(54) SYSTEMS AND METHODS FOR PROVIDING A JUNCTION BOX IN A SOLID-STATE LIGHT APPARATUS

(75) Inventor: Jonas Concepcion, Beacon, NY (US)

(73) Assignee: Toshiba International Corporation, Houston, TX (US)

( * ) Notice: Subject to any disclaimer, the term of this patent is extended or adjusted under 35 U.S.C. 154(b) by 106 days.

(21) Appl. No.: 13/237,414

(22) Filed: Sep. 20, 2011

(65) Prior Publication Data

US 2013/0063015 A1 Mar. 14, 2013

Related U.S. Application Data

(60) Provisional application No. 61/533,595, filed on Sep. 12, 2011.

(51) Int. Cl.

| | |
|---|---|
| ***F21V 17/00*** | (2006.01) |
| ***F21V 7/00*** | (2006.01) |
| ***H01J 7/24*** | (2006.01) |

(52) U.S. Cl.

USPC ..... 362/231; 362/364; 362/249.02; 362/235; 313/46

(58) Field of Classification Search

CPC ..... F21V 17/00; H01J 7/24; F21S 8/26
USPC ..... 362/364, 287, 289, 448–449; 174/50; 313/46

See application file for complete search history.

(56) References Cited

U.S. PATENT DOCUMENTS

| | | | | |
|---|---|---|---|---|
| 6,692,140 | B2 * | 2/2004 | Wu | 362/370 |
| 7,959,332 | B2 | 6/2011 | Tickner et al. | |
| 7,993,034 | B2 | 8/2011 | Wegner | |
| 8,348,477 | B2 | 1/2013 | Tickner et al. | |
| 8,348,479 | B2 | 1/2013 | Tickner et al. | |
| 2011/0193467 | A1 * | 8/2011 | Grajcar | 313/113 |
| 2011/0222291 | A1 * | 9/2011 | Peng | 362/294 |
| 2012/0275170 | A1 * | 11/2012 | Li et al. | 362/373 |

FOREIGN PATENT DOCUMENTS

| | | |
|---|---|---|
| EP | 1477726 | 4/2008 |

* cited by examiner

*Primary Examiner* — Tracie Y Green
(74) *Attorney, Agent, or Firm* — Baker Botts L.L.P.

(57) ABSTRACT

In one embodiment, the solid-state lighting apparatus includes a solid-state light source. The solid-state light source may include a first side and a second side opposite the first side, with the first side including at least one solid-state lighting element. The solid-state lighting apparatus may also include a junction box. The junction box may be positioned at least partially above the solid-state light source, proximate the second side of the solid-state light source. The solid-state lighting apparatus may further include a heat sink. The heat sink may be coupled to the junction box and thermally coupled to the solid-state light source.

20 Claims, 6 Drawing Sheets

SYSTEMS AND METHODS FOR PROVIDING A JUNCTION BOX IN A SOLID-STATE LIGHT APPARATUS

RELATED APPLICATION

This application claims the benefit of U.S. provisional patent application No. 61/533,595 filed Sep. 12, 2011, entitled "Systems and Methods for Providing a Junction Box in a Solid-State Light Apparatus," incorporated by reference herein in its entirety.

FIELD

Embodiments described herein related generally to solid-state light apparatuses and methods of manufacturing the same.

BACKGROUND

In recent years, environmental awareness has grown, increasing the demand for more durable, energy efficient lighting options, including solid-state light sources. Solid-state light sources are currently implemented in a variety of home and office environments. In certain environments, downlights using solid-state light sources are typically recessed into the ceiling. Installation and maintenance of the downlight fixtures, however, is problematic. For example, accessing the wired connections of a downlight fixture is difficult once the downlight is installed. Typically, the fixture wiring access is offset from a ceiling aperture through which the downlight fixture projects light. The fixture must be then removed from the ceiling, or an access point in the ceiling must be opened, before the fixture wiring can be accessed. What is needed is an improved way to access the wiring of a solid-state fixture.

DETAILED DESCRIPTION

Embodiments described herein are directed to a solid-state lighting apparatus. In one embodiment, the solid-state lighting apparatus includes a solid-state light source. The solid-state light source may include a first side and a second side opposite the first side, with the first side including at least one solid-state lighting element. The solid-state lighting apparatus may also include a junction box. The junction box may be positioned at least partially above the solid-state light source, proximate the second side of the solid-state light source. The solid-state lighting apparatus may further include a heat sink.

The heat sink may be coupled to the junction box and thermally coupled to the solid-state light source.

Hereinafter, embodiments will be described with reference to the drawings. Each drawing is a schematic view for describing an embodiment of the present disclosure and promoting the understanding thereof. The drawings should not be seen as limiting the scope of the disclosure. In each drawing, although there are parts differing in shape, dimension, ratio, and so on from those of an actual apparatus, these parts may be suitably changed in design taking the following descriptions and well-known techniques into account.

Figure 1:
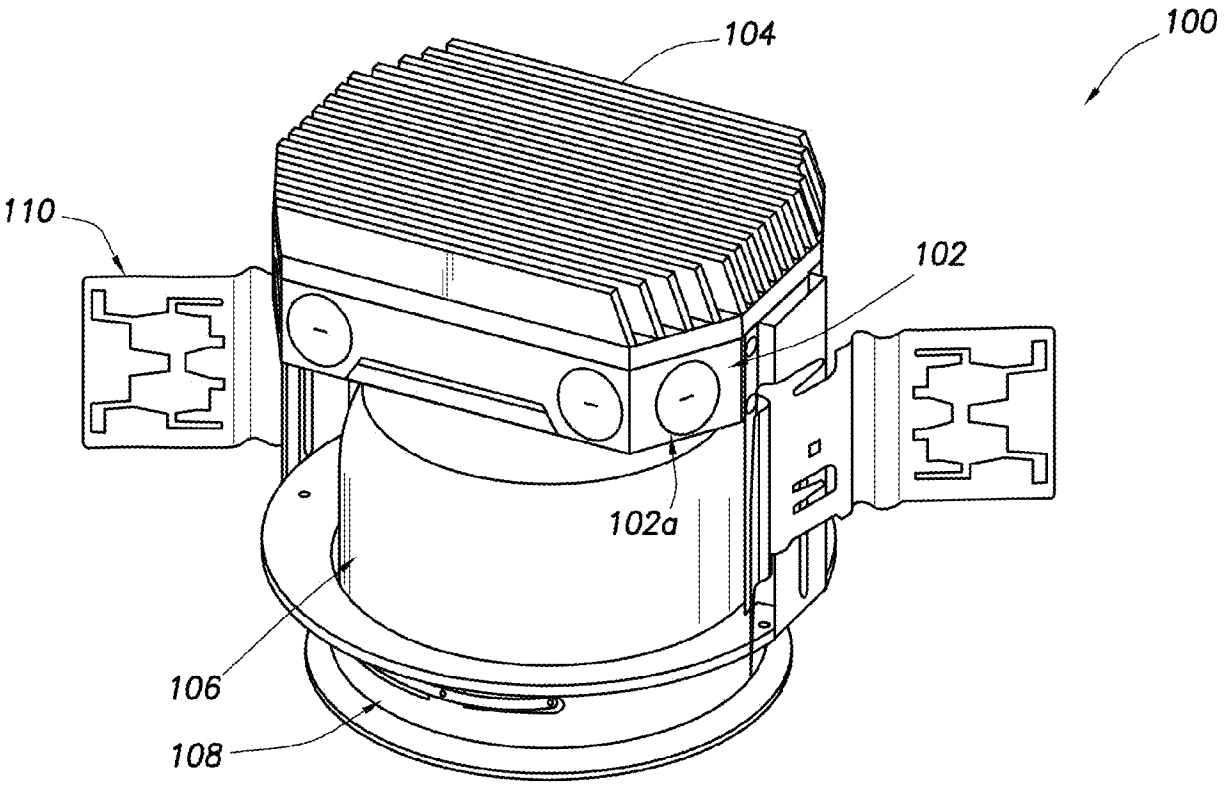
FIG. 1 shows an example embodiment of a light apparatus according to aspects of the present disclosure.

FIG. 1 illustrates an example embodiment of a solid-state lighting apparatus 100, incorporating aspects of the present disclosure. As can be seen, the solid-state lighting apparatus 100 includes a junction box 102, a heat sink 104, and a reflector 106. The solid-state lighting apparatus 100 is a solid-state downlight fixture, which may be recessed within a ceiling structure when installed. The junction box 102 is disposed above the reflector 106. The reflector 106 may include an aperture 108 through which light is projected when the solid-state lighting apparatus 100 is in an installed position and through which the internal wiring compartment of the junction box 102 may be accessed. As will be discussed below, and appreciated by one of ordinary skill in view of this disclosure, locating the junction box above the reflector is advantageous because the interior of junction box is accessible when the solid state lighting apparatus is installed.

The junction box 102 includes a plurality of conduit entry points, such a conduit knock-out 102*a*, around a side wall. The conduit knock-out 102*a* may be releasably engaged with the exterior wall of the junction box 102, such that the conduit knock-out 102*a* may be removed, leaving a circular entry point through which wiring may be introduced. The wiring may come directly from the wiring infrastructure of an office/home and may comprise a positive wire, a negative wire, a ground wire, and multiple control wires, which control, for example, an on/off and/or a dimming function of the solid-state lighting apparatus 100.

The heat sink 104 is disposed above and coupled to the junction box 102. The heat sink 104 may, in certain embodiments, be coupled to the junction box 102 by fasteners, such as screws. In certain embodiments, the heat sink 104 may be comprised of extruded aluminum. The extruded metal is not limited to aluminum, however, as other metals may be used as would be appreciated by one of ordinary skill in view of this disclosure. As will be discussed below, the heat sink may include a bottom planar surface which, when coupled to the junction box 102, comprises at least part of an exterior surface of the junction box 104.

The solid-state lighting apparatus 100 may further include mounting mechanisms, such as butterfly brackets 110. The butterfly brackets 110 may be used to install the solid-state lighting apparatus 100 within a ceiling structure, in a downlight configuration. Although butterfly brackets 110 are shown, other mounting mechanisms are possible, as would be appreciated by one of ordinary skill in the art in view of this disclosure. Additionally, although the mounting mechanisms, such as butterfly brackets 110, may be used to mount the solid-state lighting apparatus 100 in a downlight configuration, other mounting mechanisms and configurations are possible.

Figure 2A:
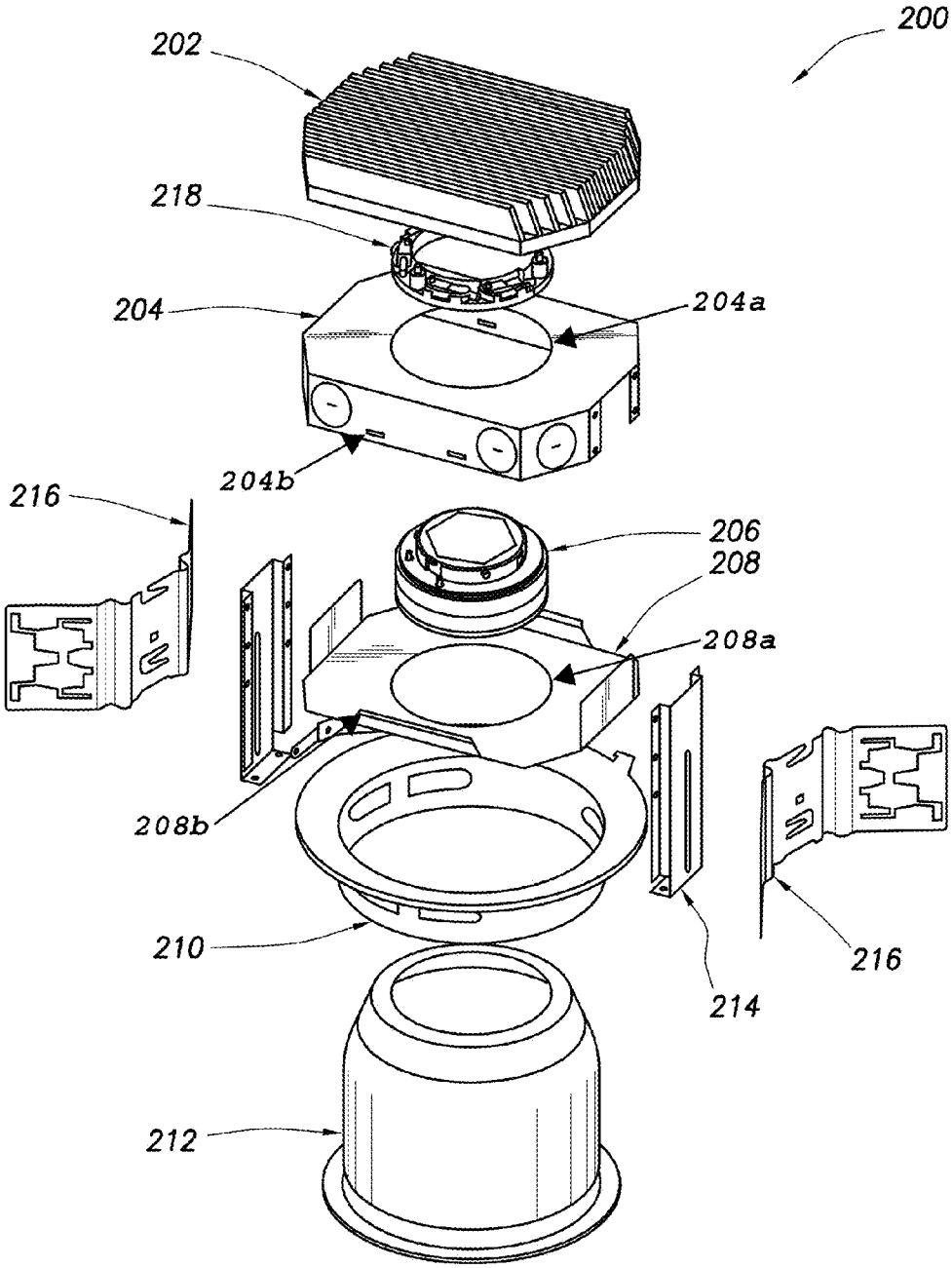
FIG. 2*a* shows example components of an example embodiment of a light apparatus according to aspects of the present disclosure.

FIG. 2*a* illustrates an example solid-state lighting apparatus 200, separated into a component view. The solid-state lighting apparatus 200 includes a heat sink 202. Like the heat sink in FIG. 1, heat sink 202 may be comprised of an extruded metal, such as aluminum. The extruded metal is not limited to aluminum, however, as other metals may be used as would be appreciated by one of ordinary skill in view of this disclosure. The heat sink 202 may include a bottom planar surface facing junction box 204. As can be seen, junction box 204 may include a top planar surface facing the heat sink 202, and the heat sink 202 may be coupled to the top planar surface of the junction box 204 via a fastener, such as screws.

As can be seen, the top planar surface of junction box 204 may include an aperture 204*a*. The aperture may be sized to accommodate a socket 218, to which a solid-state light source 206 may coupled, as will be discussed below. Like the junction box in FIG. 1, junction box 204 may include a plurality of conduit entry points, such as conduit knock-outs, around a side surface. The side surface on which the conduit entry points are disposed may also include grooves 204*b* to accommodate a snap-fit mechanism 208*b* on a removable junction box cover 208. The removable junction box cover 208 may be pressed into place on the bottom of the junction box 204, locking via press-fit mechanisms, or tabs 208*b*, disposed on an outer edge of the removable junction box cover 208. In other embodiments, the removable junction box cover 208 may be coupled to the junction box 204 via different fasteners, such as screws.

Removable junction box cover 208 may comprise an aperture 208*a* in a bottom planar surface that aligns with the aperture 204*a* in the junction box 204 when the removable junction box cover 208 in engaged with junction box 204. The aperture 208*a* may be sized to allow a solid-state light source 206 to pass through the aperture 208*a*. As will be discussed below, the solid-state light source 206 may be inserted through the aperture 208*a* in the removable junction box cover 208 and coupled with the socket 218. In certain embodiments, the socket 218 may be coupled with wires entering the junction box 204 through the conduit entry points. The wires may coupled with pre-defined connection points in the socket 218 so that the solid-state light source may be coupled to the correct wired connections upon coupling to the socket 218.

Solid-state light source 206 may be an integrated LED light source, where the LED controller resides within the solid-state light source 206, also known as LED light engines. Such engines can be compliant with Zhaga Consortium standards for interchangeable light engines, such that they can be detachably installed and replaced in a similar manner to conventional lamps. In other embodiments, the solid-state light source 206 may comprise numerous solid-state lighting configurations, such an on-chip LED configurations, as will be appreciated by one of ordinary skill in view of this disclosure. The solid-state light source 206 may include a first side, facing towards reflector 212, and a second side, opposite the first side, facing the heat sink 202. The first side may comprise at least one solid-state light element, such as an LED, and, when the solid-state lighting apparatus 200 is turned on, the solid-state light source 206 may emit light from the first side through the reflector 212. The solid-state lighting apparatus 200 may be configured, as will be discussed below, such that junction box 204 is positioned proximate the second side, in the opposite direction from the light emitted by the solid-state light source 206.

In certain embodiments, the solid-state lighting apparatus 200 may also include mounting mechanisms, such as butterfly brackets 216, rails 214, and collar 210. The mounting mechanisms may be used to install the solid-state lighting apparatus 200 in a downlight configuration, i.e. within a ceiling structure such that the solid-state lighting apparatus 200 is recessed above the ceiling line, projecting light substantially downward from the ceiling. The butterfly brackets 216 may be used to anchor the solid-state lighting apparatus 200, and the rails may be used to adjust the height of the solid-state lighting apparatus 200 relative to the butterfly brackets 216. The collar 210 may slide down around the reflector 212 to anchor the solid-state lighting apparatus 200 to the ceiling structure.

Figure 2B:
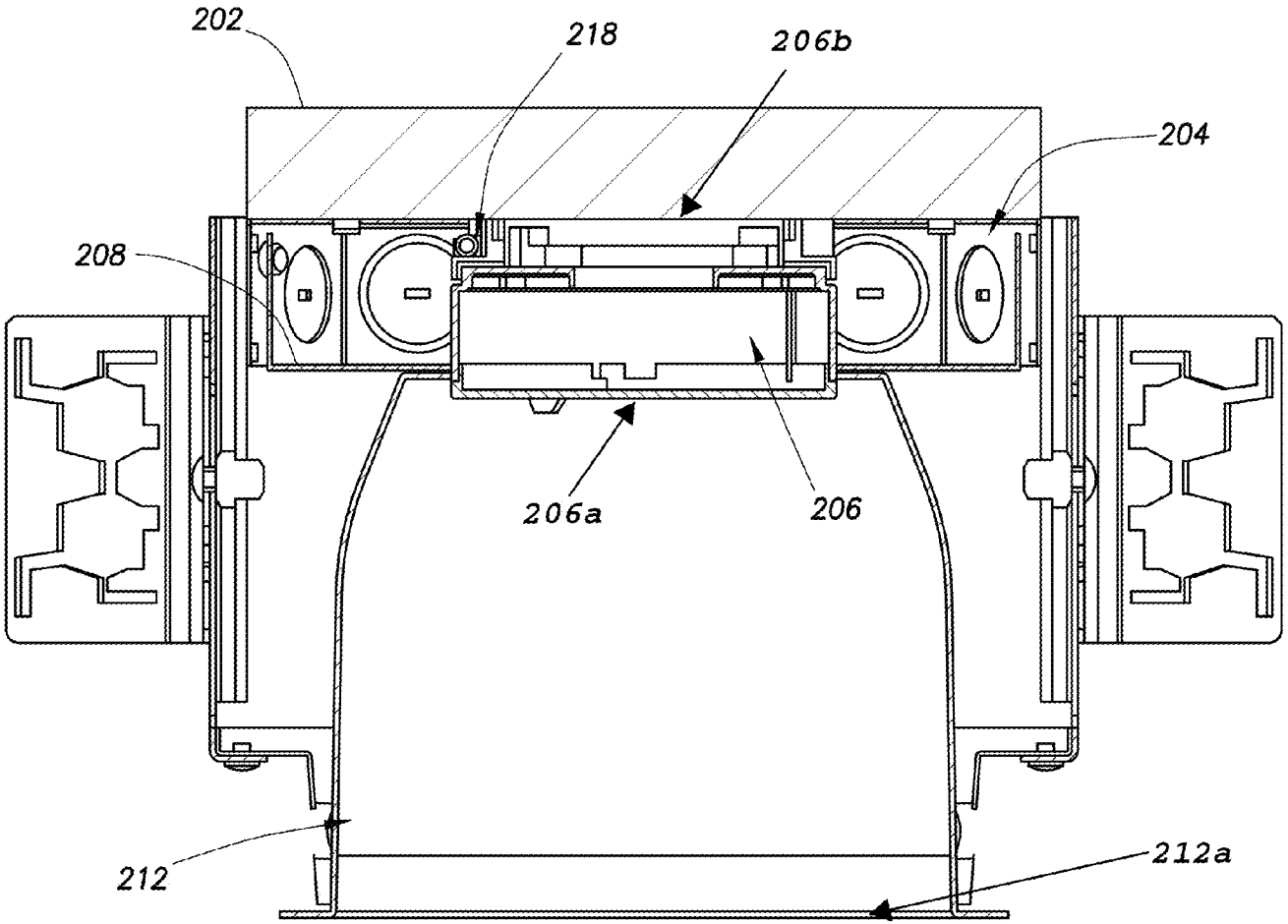
FIG. 2*b* shows a cross section of an example embodiment of a light apparatus according to aspects of the present disclosure.

FIG. 2*b* shows a cross section of the assembled light apparatus 200 from FIG. 2*a*. As can be seen, the planar surface of heat sink 202 is coupled to the top planar surface of the junction box 204. The removable junction box cover 208 is engaged with junction box 204 to form a wiring compartment. Reflector 212 may be coupled to the junction box 204 and heat sink 202 with rails, as mentioned previously. The reflector 212 includes an aperture 212*a* at the bottom of the assembled light apparatus 200, through which light emitted from a first side 206*a* of the solid-state light source 206 passes. Installing the solid-state light source 206 in the light apparatus 200 may comprise inserting the solid-state light source 206 through aperture 212*a* into the junction box 204 through aperture 208*a* in the removable junction box cover 208. The solid-state light source 206 may then couple with socket 218, which, as can be seen, is disposed at least partially within the junction box 204.

The solid-state light source 206 may be at least partially disposed within the junction box 204, which is positioned proximate a second side 206*b* of the solid-state light source 206. A first side 206*a* of the solid-state light source 206 may extend outside of the removable junction box cover 208 into the reflector 212. In certain embodiments, the solid-state light source 206 may be thermally coupled with the heat sink 202 through, for example, a thermal pad on the second side 206*b* of the solid-state light source 206. In certain embodiments, the second side 206*b* of the solid-state light source 206 may be in contact the heat sink 202, transferring heat from the solid-state light source 206 to the heat sink 202 when the light apparatus 200 is in operation. In other embodiments, the solid-state light source 206 may transfer heat to the heat sink 202 by other heat transfer mechanisms, such as metal arms protruding from the solid-state light source 206, contacting the heat sink 202.

Figure 3:
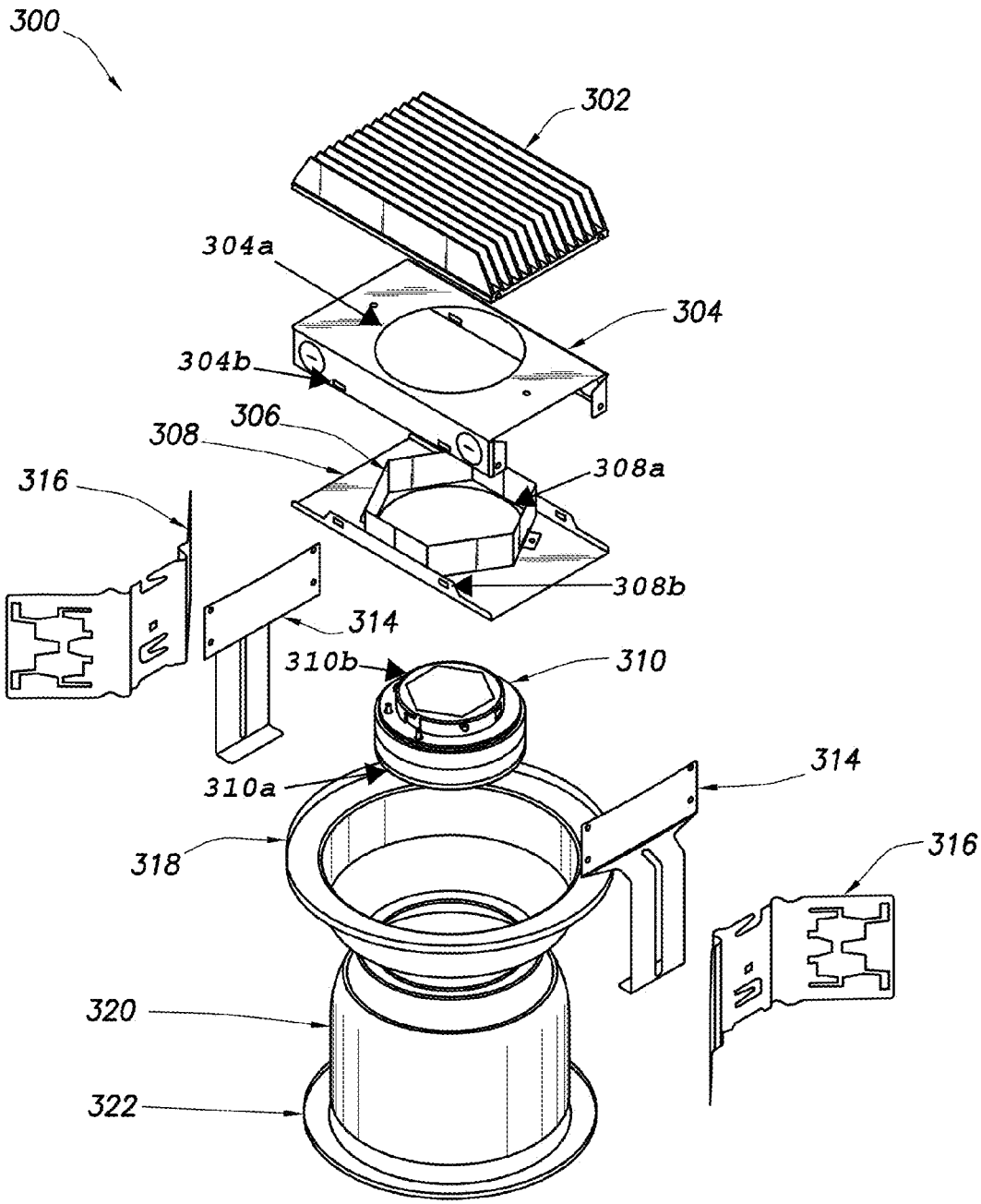
FIG. 3 shows example components of an example embodiment of a light apparatus according to aspects of the present disclosure.

FIG. 3 illustrates an additional example embodiment, incorporating aspects of the present disclosure, solid-state lighting apparatus 300. The solid-state lighting apparatus 300 include a heat sink 302 that may, like heat sink 202, be comprised of an extruded metal, such as aluminum. The heat sink 302 may have a bottom planar surface to couple with a top planar surface of a junction box 304. The top planar surface of the junction box 304 may include an aperture 304*a*. The junction box 304 may also include a plurality of conduit entry points, such as conduit knock-outs, around a side surface. The junction box 304 may further include engagement mechanisms for engaging with a removable junction box cover 308. The engagement mechanisms may include, for example, grooves 304*b*.

The grooves 304*b* of the junction box 304 may align and engage with snap-fit mechanisms 308*b* on the removable junction box cover 308. The removable junction box cover 308 may further include an aperture 308*a* disposed on a bottom planar surface, the aperture 308*a* substantially aligning with the aperture 304*a* of the junction box 304 when the removable junction box cover 308 is engaged with the junction box 304. In the embodiment shown in FIG. 3, the removable junction box cover 308 may also include compartment walls 306. In certain embodiments, compartment walls may be advantageous to provide a wiring compartment segregated from a solid-state light source 310.

Like the solid-state light source 206 of FIGS. 2*a* and 2*b*, the solid-state light source 310 of FIG. 3 includes a first side 310*a* and a second side 310*b* opposite the first side 310*a*. The first side 310*a* may include at least one solid-state element, such as an LED, and may emit light from the first side 310*a*, downwards through the aperture 322 in reflector 320. As can be seen, the junction box 304 is positioned proximate the second side 310*b* of the solid-state light source 310. In certain embodiments, the solid-state light source 310 may be at least partially disposed within the junction box 304. The second side 310*b* may also include a thermal transfer mechanism, such as the hexagonal thermal pad, that contacts heat sink 302 when the solid-state light source 310 is installed within the light apparatus 300.

Unlike the light apparatus in FIGS. 2*a* and 2*b*, the light apparatus 300 does not include a separate socket. Instead, a socket may be integrated into the solid-state light source 310. For example, upon installation, the light apparatus may be mounted within a ceiling structure in a downlight configuration using mounting mechanisms 314, 316, and 318. Wiring within the building in which the lighting apparatus 300 is being installed may be run directly into the junction box 304, through conduit entry points location on the junction box 304. The wires may be pulled into the junction box 304 and configured with the removable junction box cover 308 disengaged, allowing improved access to the wiring compartment of the junction box 304. In certain embodiments, the wiring compartment of the junction box may be accessed through an aperture 322 in a reflector 320. The solid-state light source 310 may then be inserted through the aperture 322 in a reflector 320 and wired for power.

Figure 4:
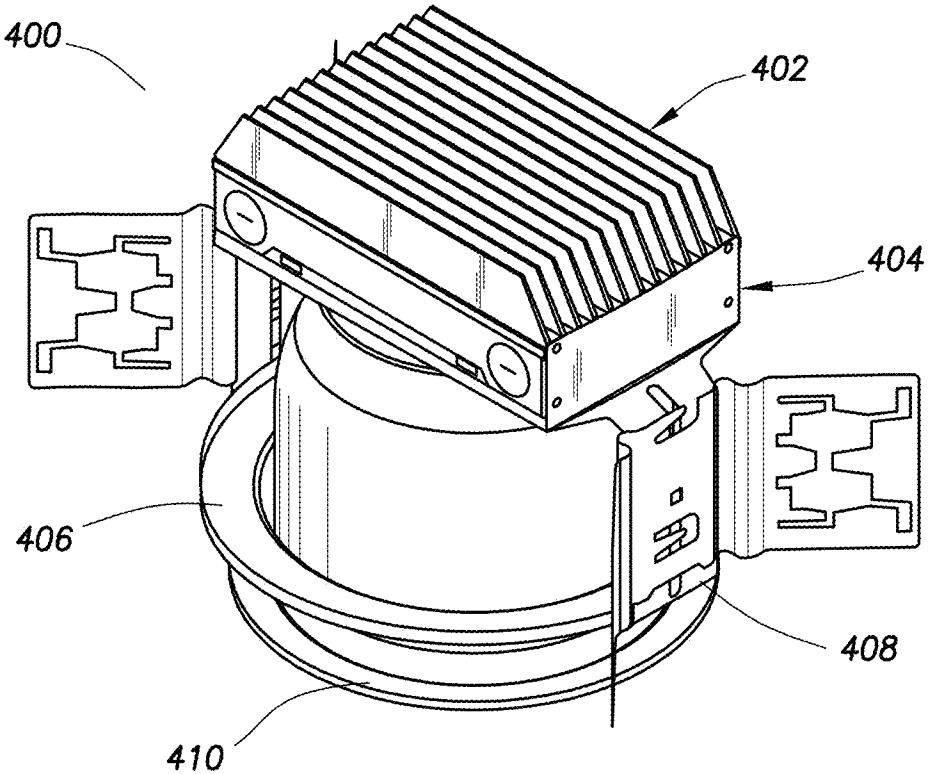
FIG. 4 shows an example embodiment of a light apparatus according to aspects of the present disclosure.

FIG. 4 illustrates an external view of an example embodiment of a solid-state lighting apparatus 400, similar to solid-state lighting apparatus 300 from FIG. 3. As can be seen, the solid-state lighting apparatus 400 includes a heat sink 402 positioned above and coupled to a junction box 404. As can also be seen, the junction box is releasably engaged with a removable junction box cover, via a snap-fit mechanism similar to that illustrated in FIG. 3. Both the heat sink 402 and junction box 404 are positions substantially above the reflector 410. In certain embodiments, the reflector 410 may be coupled to the heat sink 402 and junction box 404 via mounting mechanisms 408.

Figure 5:
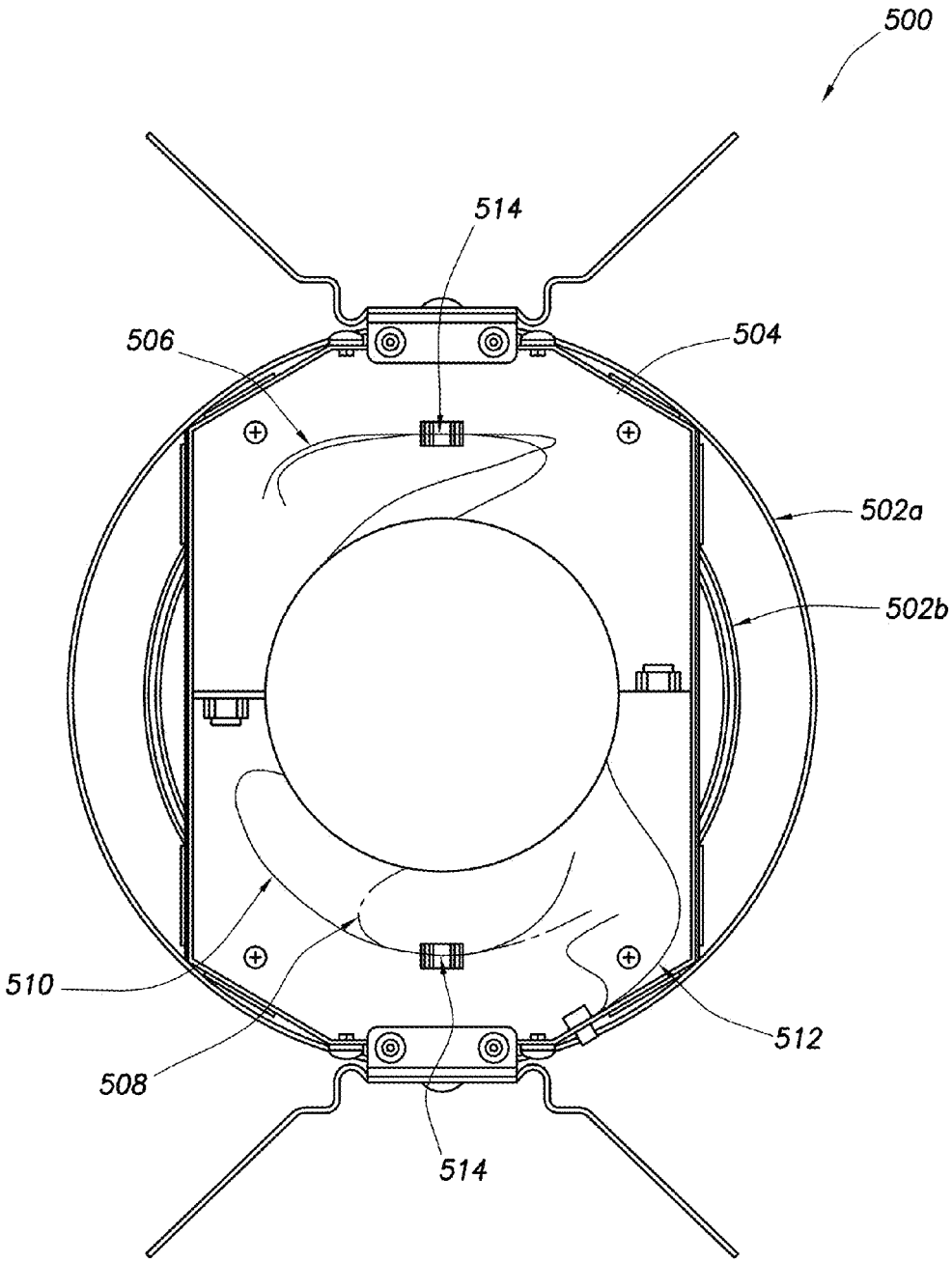
FIG. 5 shows the interior of an example embodiment of a light apparatus according to aspects of the present disclosure.

FIG. 5 illustrates an internal view of a solid-state lighting apparatus 500, such one would see looking upwards through the reflector 410 into the junction box 404 in FIG. 4. FIG. 5 illustrates an internal wiring compartment of a junction box 504 of a solid-state lighting apparatus 500. The junction box 504 may be sized such that its widest diameter is less that the widest diameter 502*a* of the reflector 502. This may be advantageous in installation procedures, as the solid-state lighting apparatus 500 may be installed directly into a ceiling recess without angling to accommodate oversized and offset elements.

The wiring compartment of the junction box 504 may receive wires from the wiring infrastructure of a building, such as an office or a home, to provide power to a solid-state light source. For example, wires 508 and 510 may comprise a 120/277V hot line and neutral line, respectively. Each of the wires may be received through a conduit entry point in the junction box (not shown) and held in place at a wire tie location 514. Each of the wires may be electrically coupled to for example, a solid-state light source or a socket, such as socket 218 in FIG. 2*a*. The junction box 504 may similarly include a ground line 512, electrically coupled to the lighting apparatus body. In certain embodiments, such as in FIG. 5, the lighting apparatus may further receive dimming lines 506, which control the brightness of the light emitted from a solid-state light source.

While certain embodiments of a solid-state lighting apparatus have been described, these embodiments have been presented by way of example only, and are not intended to limit the scope of the disclosure. Indeed, the novel systems described herein may be embodied in a variety of other forms; furthermore, various omissions, substitutions and changes in the form of the systems described herein may be made without departing from the spirit of the disclosure. The accompanying claims and their equivalent are intended to cover such forms or modifications as would fall within the scope and spirit of the disclosure.

What is claimed is:

1. A solid-state lighting apparatus, comprising:

a solid-state light source with a first side and a second side opposite the first side, wherein the first side comprises at least one solid-state lighting element;

a junction box positioned at least partially above the solid-state light source, proximate the second side; and a heat sink coupled to the junction box, wherein the heat sink is thermally coupled to the solid-state light source using a thermal transfer mechanism at least partially disposed within the junction box.

2. The solid-state lighting apparatus of claim 1, wherein the lighting apparatus comprises a downlight.

3. The solid-state lighting apparatus of claim 1, further comprising a reflector with an aperture, wherein the solid-state light source is at least partially disposed within the aperture.

4. The solid-state lighting apparatus of claim 1, wherein the solid-state light source is at least partially disposed within the junction box.

5. The solid-state lighting apparatus of claim 4, wherein the junction box comprises a cover with a snap-fit engagement mechanism.

6. The solid-state lighting apparatus of claim 5, wherein the junction box comprises at least one conduit entry point.

7. The solid-state lighting apparatus of claim 1, further comprising a socket to which the solid-state light source is detachably engaged.

8. The solid-state lighting apparatus of claim 7, wherein the socket is at least partially disposed within the junction box.

9. The solid-state lighting apparatus of claim 1, wherein the solid-state light source comprises an LED light engine.

10. A method for manufacturing a downlight with a solid-state light source, comprising:

providing a solid-state light source with a first side and a second side opposite the first side, wherein the first side comprises at least one solid-state lighting element;

providing a junction box positioned at least partially above the solid-state light source, proximate the second side; and providing a heat sink coupled to the junction box, wherein the heat sink is thermally coupled to the solid-state light source using a thermal transfer mechanism at least partially disposed within the junction box.

11. The method of claim 10, wherein the lighting apparatus comprises a downlight.

12. The method of claim 10, further comprising a reflector with an aperture, wherein the solid-state light source is at least partially disposed within the aperture.

13. The method of claim 10, wherein the solid-state light source is at least partially disposed within the junction box.

14. The method of claim 13, wherein the junction box comprises a cover with a snap-fit engagement mechanism.

15. The method of claim 14, wherein the junction box comprises at least one conduit entry point.

16. The method of claim 10, further comprises a socket coupled to the solid-state light source.

17. The method of claim 16, wherein the socket is at least partially disposed within the junction box.

18. A light emitting diode ("LED") downlight apparatus, comprising:

a reflector, wherein the reflector includes an aperture;

an integrated LED bulb, wherein the integrated LED bulb comprises a first side and a second side opposite the first side, wherein the first side comprises at least one LED, and wherein the integrated LED bulb is at least partially disposed within the aperture;

a junction box, wherein the junction box is positioned proximate the second side of the integrated LED bulb, and wherein the integrated LED bulb is at least partially disposed within the junction box;

a socket, wherein the socket is at least partially disposed within the junction box, and wherein the integrated LED bulb is operable to removably engage with the socket; and a heat sink, wherein the heat sink is thermally coupled to the integrated LED bulb using a thermal transfer mechanism at least partially disposed within the junction box.

19. The LED downlight apparatus of claim 18, wherein the junction box comprises a cover with a snap-fit engagement mechanism.

20. The LED downlight apparatus of claim 19, wherein the junction box is accessible through the aperture.

* * * * *